United States Patent [19]

Franck et al.

[11] Patent Number: 4,588,495

[45] Date of Patent: May 13, 1986

[54] CATALYTIC REFORMING PROCESS

[75] Inventors: Jean-Pierre Franck, Bougival; Jean-Paul Bournonville, Chatou, both of France

[73] Assignee: Institut Francais du Petrole, Rueil-Malmaison, France

[21] Appl. No.: 704,456

[22] Filed: Feb. 22, 1985

[30] Foreign Application Priority Data

Feb. 23, 1984 [FR] France ..... 84 02926

[51] Int. Cl.[4] ..... C10G 35/06

[52] U.S. Cl. ..... 208/65; 208/64

[58] Field of Search ..... 208/64, 65

[56] References Cited

U.S. PATENT DOCUMENTS 3,669,875 6/1972 Plank et al. ..... 208/65

4,401,557 8/1983 Juguin et al. ..... 208/139

*Primary Examiner*—Curtis R. Davis

*Attorney, Agent, or Firm*—Millen & White

[57] ABSTRACT

In a catalytic reforming process wherein a charge is circulated successively through a first catalyst bed and then at least one further catalyst bed, the improvement wherein the catalyst of the first bed comprises a carrier of alumina base and, by weight in proportion to the carrier, 0.05–0.6% of platinum, 0.005–3% of rhenium and 0.1–15% of at least one halogen and wherein each catalyst of the other beds contains a carrier of alumina base and, by weight with respect to the carrier, 0.05–0.6% of platinum, 0.05–3% of at least one metal promoter selected from the group consisting of tin, thallium and indium and 0.1–15% of at least one halogen, the proportion by weight of the catalyst containing platinum and rhenium ranging from 8 to 40% with respect to the total catalyst mass used in all the catalyst beds.

13 Claims, 4 Drawing Figures

NOR $C_5^+$ 100
95
90
85
0
50
100
h
1
2
3
4
1 = A ( Pt - Re)
2 = Pt - Re - Sn
3 = B ( Pt - Ir - In )
4 = A+B

H² % pds 3,0
2,5
2,0
1,5
0
50
100
h
3
4
2
1
1 = A (Pt - Re)
2 = Pt - Re - Sn
3 = B (Pt - Ir - In)
4 = A+B

NOR $C_5^+$ 100
95
90
85
50
100
h
1
2
3
4
1 = A ( Pt - Re )
2 = Pt - Re - Sn
3 = C ( Pt - Sn )
4 = A+C

H²% pds 30
25
20
15
0
50
100
h
4
3
2
1
1 = A (Pt-Re)
2 = Pt - Re - Sn
3 = C (Pt - Sn)
4 = A+C

CATALYTIC REFORMING PROCESS

BACKGROUND OF THE INVENTION

In the field of catalytic reforming or of aromatic hydrocarbons production, the catalysts with an alumina base, containing, in addition to a noble metal of group VIII (generally platinum), a metal promoter consisting of rhenium (U.S. Pat. No. 3,415,737) are known for their industrial impact. Also the catalysts with a group VIII noble metal base (usually platinum) and containing, as promoter, for example tin or indium or thallium (U.S. Pat. No. 3,700,588 - U.S. Pat. No. 2,814,599) are known to form new races of catalysts.

These catalysts have been tested and used over very long periods, for example of about one year and, whereas the platinum-rhenium catalyst shows an excellent stability, it does not give a maximum selectivity in the production of high grade gasolines. Conversely, platinum-tin, platinum-indium or platinum-thallium catalysts give an excellent selectivity but their stability remains insufficient.

Accordingly, it appeared judicious to use catalysts containing, in addition to platinum, both promoters simultaneously, for example rhenium and tin (U.S. Pat. No. 3,702,294). However, the selectivity obtained by using this type of catalyst was still lower than that obtained with a platinum-tin or platinum-indium or platinum-thallium catalyst and, in addition, this catalyst was also less stable than the platinum-rhenium catalyst.

OBJECT OF THE INVENTION

It is an object of the invention to produce gasolines of high grade over long periods (hence with a good stability) and with a very good selectivity, by first contacting the charge with a platinum-rhenium catalyst and then with a platinum catalyst containing at least one metal promoter selected from the group consisting of tin, indium and thallium.

SUMMARY OF THE INVENTION

The process of the invention consists of circulating a charge successively through at least 2 fixed beds of catalyst, the catalyst of the first bed wherethrough passes the charge (optionally also the catalyst of the second bed traversed by the charge) containing:

(a) a carrier of alumina base, (b) 0.05–0.6% by weight of platinum with respect to the carrier and preferably 0.1–0.5%, (c) 0.005–3 % by weight of rhenium with respect to the carrier, preferably 0.07–2%, more particularly 0.1–0.5%, (d) 0.1–15% of at least one halogen, by weight with respect to the carrier, for example chlorine or fluorine, the catalysts of the one or more other fixed beds (identical or different) containaing:

(a) a carrier of alumina base, (b) 0.05–0.6% by weight of platinum with respect to the carrier, preferably 0.1–0.5%, (c) 0.05–3% by weight of at least one metal promoter selected from tin, indium, thallium, preferably 0.07–2% particularly 0.1–0.6%, optionally with the addition of 0.005–0.3% iridium, and (d) 0.1–15% of at least one halogen by weight with respect to the carrier, for example chlorine and fluorine.

The proporation by weight of the rhenium-containing catalyst ranging from 8 to 40%, preferably from 10 to 20% with respect to the total catalyst mass used in all the catalyst beds.

BRIEF DESCRIPTION OF THE DRAWINGS

A variety of objects, features and attendant advantages of the present invention will be more fully appreciated as the same becomes better understood when considered in connection with the accompanying drawings, in which like reference characters designate the same or similar parts throughout the several views, and wherein.

Figure 1:
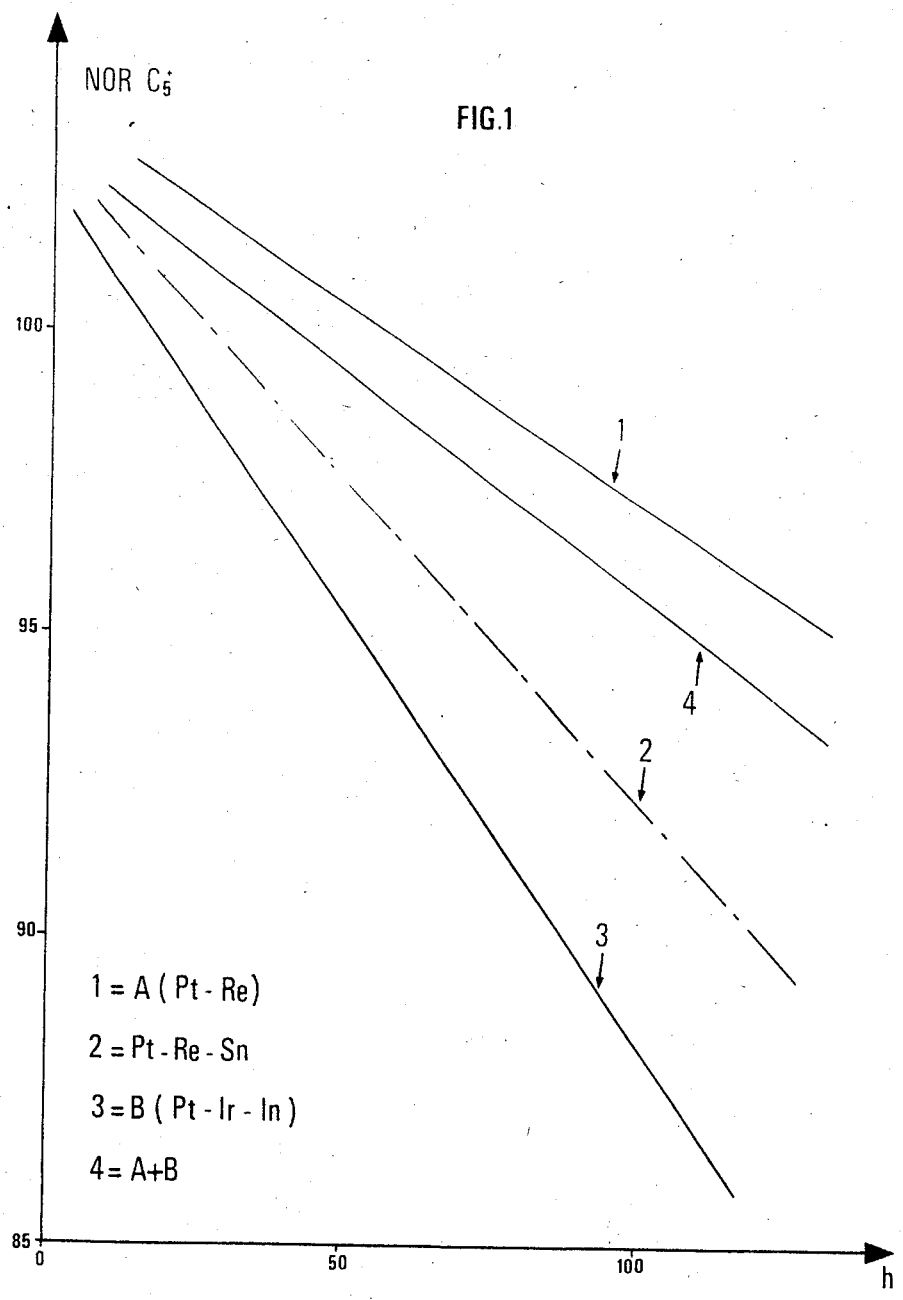
FIGS. 1–3 disclose the resulting research octane number of $C_5^+$ reformate and the hydrogen yield in weight % by respect to the charge, which results from four tests, each test utilizing a specific catalyst composition which is present in each of the three reactors.

By way of example, a single reactor comprising at least 3 separate catalyst beds can be used. The first catalyst bed wherethrough passes the charge (upper bed when the charge flows downwardly or lower bed when the charge flows upwardly) consisting of a platinum and rhenium catalyst, the other beds being formed with a catalyst containing platinum and at least one metal promoter selected from thallium, indium and tin: each of said other beds may contain a different promoter.

An additional embodiment comprises 2 fixed bed reactors, serially arranged either side by side or superposed. The first fixed bed reactor wherethrough passes the charge contains one or more catalyst beds of platinum and rhenium catalyst, the one or more other reactors containing one or more beds of catalyst containing platinum and at least one other metal promoter, identical or different.

Many other various arrangements of catalyst beds in series may be considered, the essential feature of the invention being that the charge first passes through at least one bed of platinum and rhenium catalyst.

In the catalytic zones other than that or those containing platinum and rhenium, the following metals associations can be used:

platinum and tin,
platinum and indium,
platinum and thallium,
platinum, iridium and indium,
platinum, iridium and tin.

The preferred associations are platinum-tin and platinum, iridium and indium.

When several (at least 2) catalyst beds contain platinum, said promoter metal or metals and optionally iridium, the same catalyst can be used in these beds but also different catalysts may be used in each of these beds. Thus these catalysts may differ from one another by their metal concentration of platinum, of promoters, of iridium, by the nature of the promoter, by the optional presence of iridium, by the halogen concentration, etc.

In the reforming reactions, the lack of selectivity generally leads to a low yield of naphthenes undergoing dehydrogenation to aromatic hydrocarbons, in a parasitic cracking of paraffins with secondary formation of olefinic hydrocarbons from which coke formation will originate. By the present process it is possible to dehydrogenate to a maximum extent the naphthenic hydrocarbons to aromatic hydrocarbons, to mimimize paraffins cracking and thus, instead of producing light hydrocarbons, to convert them also, in a maximum proportion, to aromatic hydrocarbons. Thus, according to the invention, the first reaction zone, where the catalyst stability is excellent, is essentially used to dehydrogenate hydrocarbons, particularly naphthenes, to aromatic hydrocarbons and the other reaction zones, in view of the selectivity obtained by a convenient selection of the catalyst, are used mainly to perform reactions of paraffins cyclization without cracking the latter.

EXAMPLES

The following examples illustrate the invention without limiting the scope thereof.

EXAMPLE 1

The treated charge has the following characteristics:
ASTM distillation: 90°–160° C.
density at 15° C.: 0.741
composition:
paraffinic hydrocarbons: 62% by volume
naphthenic hydrocarbons: 27% by volume
aromatic hydrocarbons: 11% by volume The charge is treated with hydrogen and in operating conditions equivalent for the catalysts to accelerated aging tests, the conditions being as follows:
Pressure: 7 bars
Temperature: 500° C.
$H_2$/HC (molar): 2
Hourly flow rate of liquid charge: 3 times the total catalyst volume.

The charge flows successively through 3 reactors in series with catalyst fixed beds, the first reactor containing a catalyst A and the second and third reactors each containing the same amount of catalyst B.

Catalyst A amounts to 15% by weight of the total catalyst amount used in the 3 reactors (catalyst B thus amounting to 85% by weight of the total catalyst mass). Catalyst A contains 0.4% platinum and 0.3% rhenium by weight with respect to the catalyst carrier which is an alumina of 240 $m^2/g$ specific surface and 0.57 cc/g pore volume.

Catalyst A further contains 1.12% of chlorine. (The specific surface and the pore volume of catalyst A are respectively 230 $m^2/g$ and 0.54 cc/g).

Catalyst B comprises the same alumina carrier as Catalyst A and contains, in proportion by weight with respect to said carrier:
0.4% platinum
0.1% iridium
0.2% indium, and
1.12% chlorine
(the specific surface and the pore volume of catalyst B are respectively 230 $m^2/g$ and 0.54 cc/g).

The following Table 1 gives, in column 1, the total "material" balance obtained after 100 hours of run. This table gives also, by way of comparison, in column 1, the material balance obtained when using catalyst B in the 3 reactors.

Figure 2:
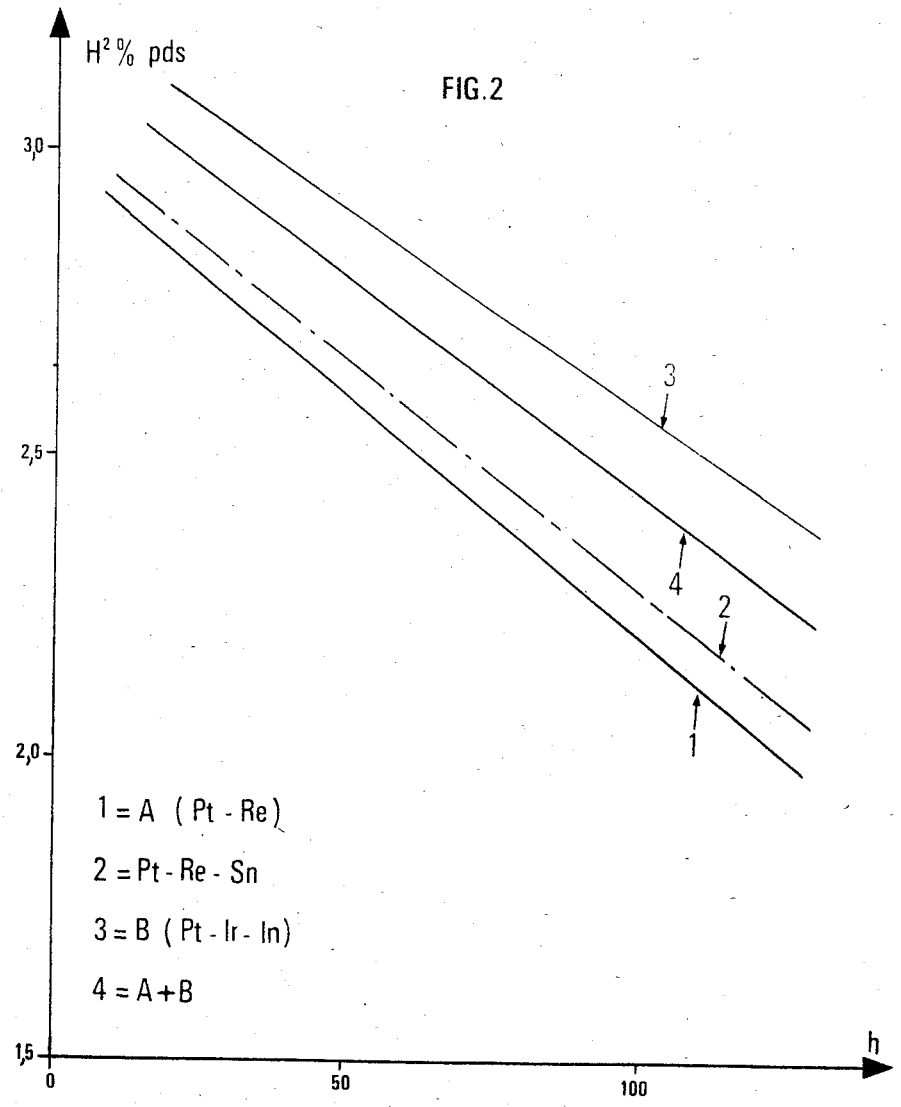

FIGS. 1 and 2 show respectively the Research octane number of $C_5$+ reformate and the hydrogen yield (% by weight with respect to the charge), versus time, in 4 tests:

(1) Use of catalyst A (platinum-rhenium) in the three reactors (curve 1).

(2) Use in the three reactors or a precedingly used catalyst of alumina base (curve 2), containing:
0.4% platinum
0.15% rhenium
0.15% tin
1.12% chlorine (3) Use in the three reactors of catalyst B (platinum-indium-iridium) (curve 3).

(4) Use, according to the invention, of catalyst A (platinum-rhenium) in the first reactor and catalyst B (platinum-indium-iridium) in the 2 other reactors. (distribution by weight: 15% catalyst A and 85% catalyst B) (curve 4).

TABLE 1

MATERIAL BALANCE AFTER 100 h OF RUN (% BY WEIGHT)

| | COLUMN 1 CATALYST B in the 3 reactors | COLUMN 2 CATALYST A in the first reactor CATALYST B in the 2 other reactors |
|---|---|---|
| $H_2$ | 2.04 | 2.43 |
| $C_1 + C_2$ | 1.90 | 2.70 |
| $C_3 + C_4$ | 4.56 | 5.87 |
| $C_5$+ | 91.50 | 89.0 |
| Properties of $C_5$+ fraction | | |
| $d_4^{15}$ | 0.782 | 0.791 |
| RON | 88 | 96 |
| Olefins % by weight | 1.1 (a) | 0.8 |
| naphthenes % by weight | 7.5 (b) | 2.9 |
| aromatics % by weight | 52.9 | 64.9 |

(a) coke precursors
(b) low dehydrogenating activity

From this example, the following observations can be made:

The use of Pt-Re in all the reactors gives an excellent $C_5$+ RON (curve 1 of FIG. 1) but an unsatisfactory hydrogen yield (curve 1 of FIG. 2);

The use of Pt-Re-Sn (as compared to Pt-Re) improves the hydrogen yield (curve 2 of FIG. 2) at the cost of a substantial decrease (still as compared to Pt-Re) of the $C_5$+ RON (curve 2 of FIG. 1);

the use of Pt-Ir-In gives an excellent hydrogen yield (curve 3 of FIG. 2) but, by way of compensation, results in a too low $C_5$+ RON (curve 3 of FIG. 1); but the selection of a Pt-Re catalyst in the first reactor (as shown above, this catalyst results in a bad hydrogen yield) in combination with a Pt-Ir-In catalyst in the two other reactors (as shown above, this catalyst by itself gives a very disappointing $C_5$+ RON) unexpectedly provides not only a very satisfactory $C_5$+ RON (curve 4 of FIG. 1) but also a very satisfactory hyrogen yield (curve 4 of FIG. 2).

EXAMPLE 2

Figure 3:
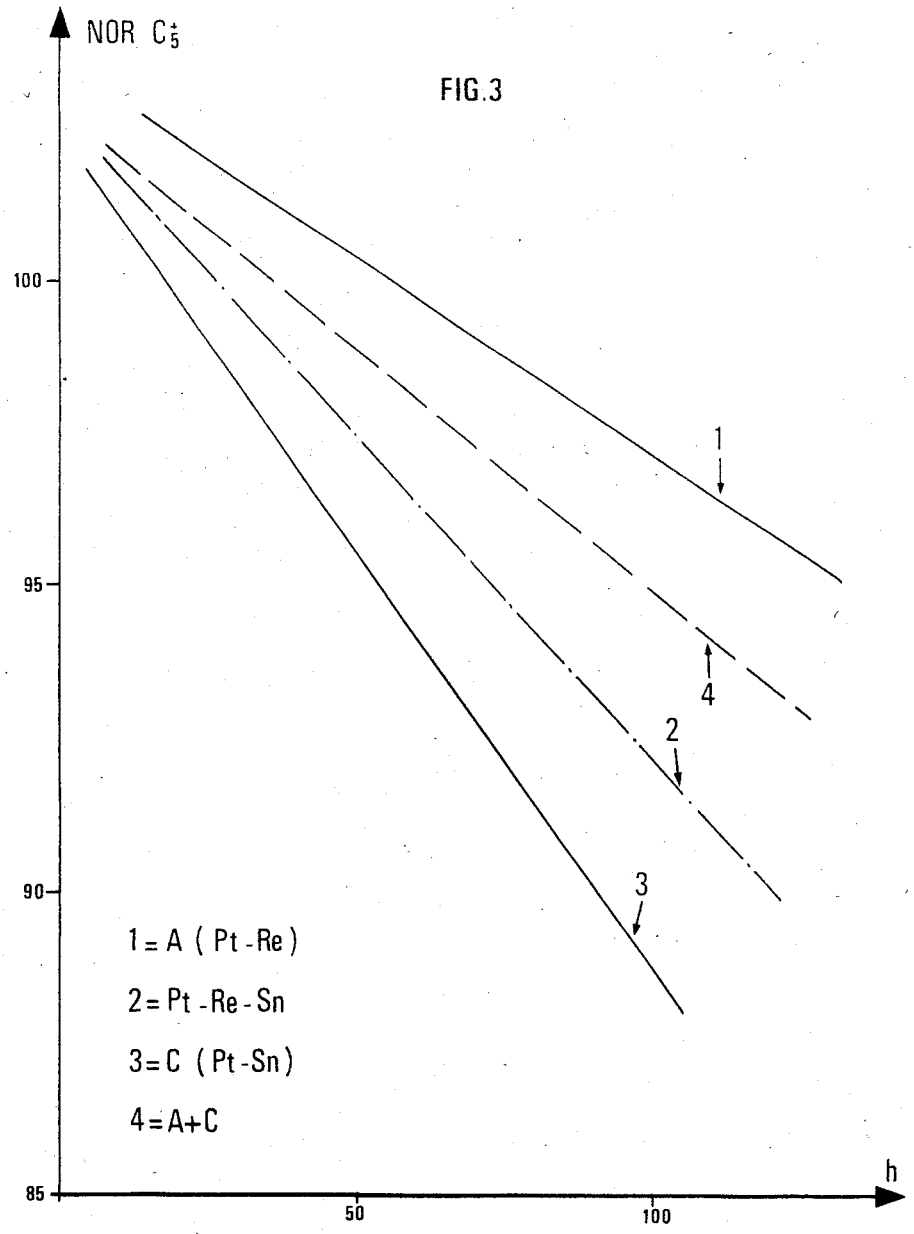
Figure 4:
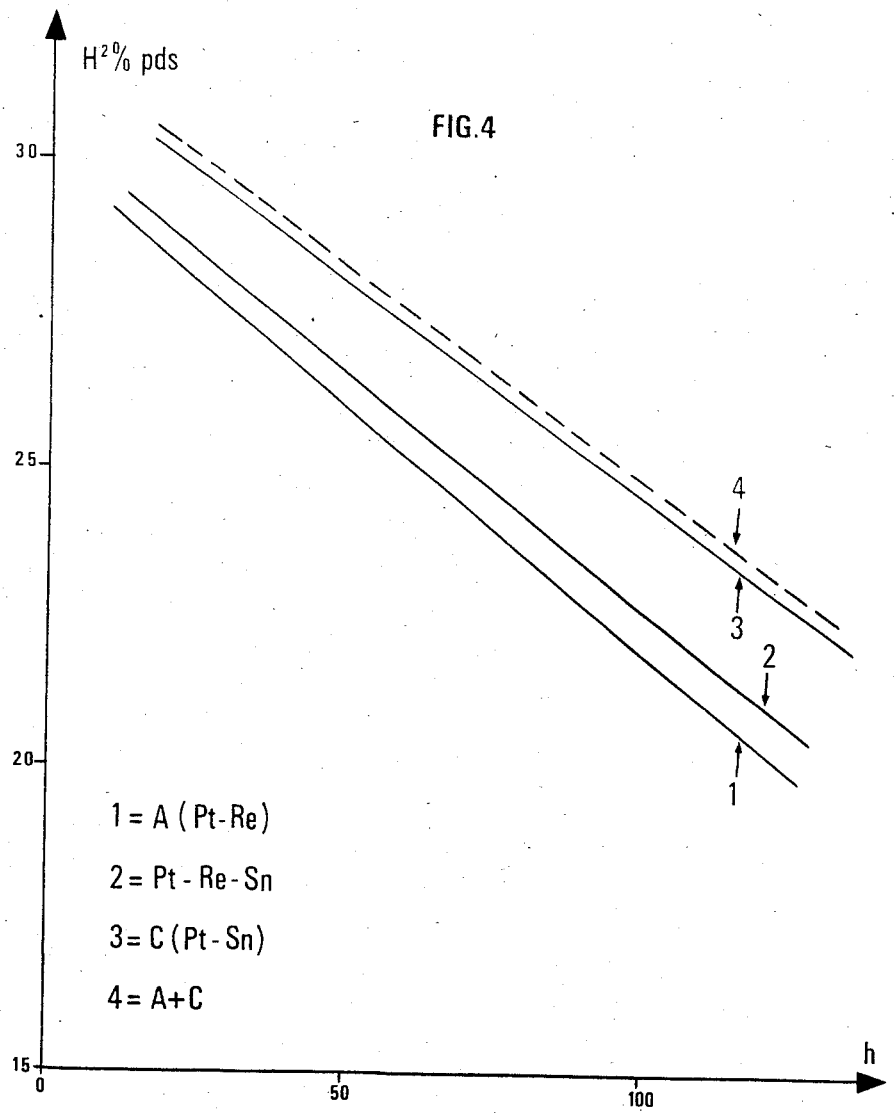
FIG. 4 discloses the usage of two differing catalysts in the three reactor system.

The operation is conducted as in example 1 but by replacing catalyst B (Pt-In-Ir) with a catalyst C containing:
0.4% platinum
0.3% tin, and
1.12% chlorine The octane number and the hydrogen yield are respectively given in FIGS. 3 and 4, versus time:

Curve (1) with catalyst A (Pt-Re as in example 1) used in the 3 reactors;

curve (2) with catalyst Pt-Re-Sn (as in example 1) used in the three reactors;

curve (3) with catalyst C (Pt-Sn) used in the three reactors;

curves (4) with a successive use of catalyst A (in the first reactor) and catalyst C in the two other reactors (catalyst A amounting to 15% by weight of the total catalyst mass).

From this example, the following observations can be made:

the use of Pt-Re in all the reactors gives an excellent $C_5+$ RON (curve 1 of FIG. 3) but a disappointing hydrogen yield (curve 1 of FIG. 4);

as precedingly, the use of Pt-Re-Sn (as compared to Pt-Re) improves the hydrogen yield (curve 2 of FIG. 4) at the cost of a substantial decrease (still as compared to Pt-Re) of $C_5+$ RON (curve 2 of FIG. 3);

the use of Pt-Sn gives an excellent hydrogen yield (curve 3 of FIG. 4) but, by way of compensation, gives an insufficient $C_5+$ RON (curve 3 of FIG. 3); but the selection of a Pt-Re catalyst in the first reactor (as above described said catalyst gives a poor hydrogen yield) used in combination with a Pt-Sn catalyst in the two other reactors (catalyst which gives a bad $C_5+$ RON) unexpectedly provides for both a very satisfactory $C_5+$ RON (curve 4 of FIG. 3) and also a high hydrogen yield (curve 4 of FIG. 4).

What is claimed as the invention is:

1. In a catalytic reforming process wherein a charge is circulated successively through a first catalyst bed and then at least one further catalyst bed, the improvement wherein the catalyst of the first bed comprises a carrier of alumina base and, by weight in proportion to the carrier, 0.05–0.6% of platinum, 0.005–3% of rhenium and 0.1–15% of at least one halogen and wherein each catalyst of the other beds contains a carrier of alumina base and, by weight with respect to the carrier, 0.05–0.6% of platinum, 0.05–3% of at least one metal promoter selected from the group consisting of tin, thallium and indium and 0.1–15% of at least one halogen, the proportion by weight of the catalyst containing platinum and rhenium ranging from 8 to 40% with respect to the total catalyst mass used in all the catalyst beds.

2. A process according to claim 1, wherein the catalyst of the first catalyst bed wherethrough passes the charge contains, in proportion by weight to the alumina carrier, 0.1–0.5% of platinum and 0.07–2% of rhenium.

3. A process according to claim 1, wherein the catalyst other than that of the first catalyst bed contains, in proportion by weight to the carrier, 0.1–0.5% of platinum and 0.07–2% of at least one metal promoter.

4. A process according to claim 1, wherein the proportion by weight of the catalyst of the first catalyst bed ranges from 10 to 20% of the total catalyst mass.

5. A process according to claims 1, wherein the catalyst containing platinum and at least one metal promoter, further contains 0.005–0.3% of iridium.

6. A process according to claim 1, wherein said metal promoter is tin.

7. A process according to claim 1, wherein said metal promoter is indium.

8. A process according to claim 1, wherein said metal promoter is thallium.

9. A process according to claim 2, wherein rhenium is present in an amount of 0.1 to 0.5% in proportion by weight to the alumina carrier.

10. A process according to claim 3, wherein the promoter is present in an amount of 0.1 to 0.6% in proportion by weight to the carrier.

11. A process according to claim 1 comprising three catalyst beds.

12. A process according to claim 1 comprising two catalyst beds.

13. In a catalytic reforming process wherein a charge is circulated successively through a first catalyst bed and then at least one further catalyst bed, the improvement wherein the catalyst of the first bed consists essentially of a carrier of alumina base and, by weight in proportion to the carrier, 0.05–0.6% of platinum, 0.005–3% of rhenium and 0.1–15% of at least one halogen and wherein each catalyst of the other beds consists essentially of a carrier of alumina base and, by weight with respect to the carrier, 0.05–0.6% of platinum, 0.05–3% of at least one metal promoter selected from the group consisting of tin, thallium and indium and 0.1–15% of at least one halogen, the proportion by weight of the catalyst containing platinum and rhenium ranging from 8 to 40% with respect to the total catalyst mass used in all the catalyst beds.

* * * * *